US008205762B2

(12) United States Patent
Carroll

(10) Patent No.: US 8,205,762 B2
(45) Date of Patent: Jun. 26, 2012

(54) SAFETY CAP ASSEMBLY AND CONTAINER SYSTEM

(76) Inventor: Craig Carroll, Newport Beach, CA (US)

( * ) Notice: Subject to any disclaimer, the term of this patent is extended or adjusted under 35 U.S.C. 154(b) by 773 days.

(21) Appl. No.: 12/245,502

(22) Filed: Oct. 3, 2008

(65) Prior Publication Data

US 2009/0095700 A1 Apr. 16, 2009

Related U.S. Application Data

(60) Provisional application No. 60/978,127, filed on Oct. 7, 2007.

(51) Int. Cl.
*B65D 55/02* (2006.01)

(52) U.S. Cl. ..... 215/222; 215/211; 215/215; 215/220; 215/330; 215/342; 222/521

(58) Field of Classification Search ..... 215/211, 215/214, 216–223, 317, 318, 334, 337, 339, 215/342, 43, 44, 46, 204, 213, 277, 301, 215/315, 329–332; 401/126, 127; 220/254.1, 220/254.2, 254.7–254.9, 256.1, 259.3–259.5; 222/91, 153.02, 153.04, 153.1
See application file for complete search history.

(56) References Cited

U.S. PATENT DOCUMENTS 670,992 A * 4/1901 Lomax et al. ..... 215/296
809,213 A * 1/1906 Osgood ..... 215/251
833,446 A * 10/1906 Degener ..... 215/207
1,343,962 A * 6/1920 Byrne ..... 215/207
2,050,754 A * 8/1936 Herrmann ..... 215/342
2,732,089 A * 1/1956 Frydlender ..... 215/342
3,088,616 A * 5/1963 Freda ..... 215/342
3,095,817 A 7/1963 Clark
3,199,704 A * 8/1965 Davidson ..... 215/334
3,231,156 A * 1/1966 Schultz ..... 222/92
3,243,071 A * 3/1966 Kimmel ..... 215/260
3,559,832 A * 2/1971 Balducci ..... 215/223
3,613,928 A * 10/1971 Landen ..... 215/214
3,696,955 A * 10/1972 Kundt et al. ..... 215/217
3,716,161 A * 2/1973 Julian et al. ..... 215/330
3,735,887 A * 5/1973 Morris ..... 215/221
3,771,682 A * 11/1973 Chacos ..... 215/208
3,843,006 A * 10/1974 Naito et al. ..... 215/220
3,863,798 A * 2/1975 Kurihara et al. ..... 215/301
3,896,959 A 7/1975 Roy
3,968,894 A * 7/1976 Herrmann ..... 215/220
4,190,173 A * 2/1980 Mason et al. ..... 220/203.05
4,313,686 A * 2/1982 Proffer ..... 401/127
4,337,869 A * 7/1982 Guinle ..... 215/201
4,376,495 A * 3/1983 Spatz ..... 222/46
4,424,918 A * 1/1984 Stull ..... 222/153.14
4,498,609 A * 2/1985 Stock ..... 222/420

(Continued)

FOREIGN PATENT DOCUMENTS

WO PCT/US2008/078806 8/2008

*Primary Examiner* — J. Gregory Pickett
*Assistant Examiner* — Ned A Walker
(74) *Attorney, Agent, or Firm* — John K. Buche; Buche & Associates, P.C.

(57) ABSTRACT

Disclosed is a safety cap assembly and corresponding container. The container may feature recessed projections which have notches and the cap may feature a flexor and lugs wherein the lugs interact with the notches under a force from the flexor to prevent removal of the cap by pulling or twisting.

6 Claims, 4 Drawing Sheets

U.S. PATENT DOCUMENTS 4,523,688 A * 6/1985 Puresevic et al. ..... 215/220
4,534,482 A * 8/1985 Bouche ..... 215/272
4,567,992 A * 2/1986 Davis ..... 215/222
4,632,264 A * 12/1986 Evans ..... 215/220
4,768,682 A * 9/1988 Friedrich ..... 222/153.09
4,773,572 A * 9/1988 Stull ..... 222/521
4,801,028 A * 1/1989 Puresevic et al. ..... 215/220
4,832,218 A * 5/1989 Gibilisco ..... 215/220
4,834,251 A * 5/1989 Yu ..... 215/222
4,921,366 A * 5/1990 Hurrell ..... 401/126
4,941,598 A * 7/1990 Lambelet et al. ..... 222/321.6
4,979,648 A * 12/1990 Montgomery et al. .. 222/153.14
5,056,676 A * 10/1991 Allen et al. ..... 215/284
5,114,029 A * 5/1992 Gibilisco ..... 215/220
5,116,154 A * 5/1992 Fulkerson ..... 401/127
5,161,706 A * 11/1992 Weinstein ..... 215/223
5,181,624 A * 1/1993 Petit ..... 215/330
5,228,583 A * 7/1993 Weinstein ..... 215/220
5,246,145 A * 9/1993 Leoncavallo et al. .... 222/153.14
5,303,835 A * 4/1994 Haber et al. ..... 215/247
5,388,727 A * 2/1995 Jouillat ..... 222/94
5,501,370 A * 3/1996 Okamura et al. ..... 222/111
5,505,342 A * 4/1996 Okamura et al. ..... 222/212
5,533,823 A * 7/1996 Pierpont et al. ..... 401/98
5,560,505 A * 10/1996 Schneider et al. ..... 215/330
5,602,530 A * 2/1997 Holmgren ..... 340/572.1
5,615,787 A * 4/1997 Morris, Sr. ..... 215/217
5,799,829 A * 9/1998 Lier et al. ..... 222/83
5,819,968 A * 10/1998 Jones ..... 215/222
5,857,796 A * 1/1999 Waldmann ..... 401/277
5,871,128 A * 2/1999 Carroll ..... 222/568
5,876,137 A * 3/1999 Byrd ..... 401/78
5,934,457 A * 8/1999 Ueda et al. ..... 206/204
6,036,036 A * 3/2000 Bilani et al. ..... 215/216
6,065,648 A * 5/2000 Tauber ..... 222/153.14
6,135,329 A * 10/2000 Stoneberg et al. ..... 222/521
6,149,022 A * 11/2000 Akyildiz et al. ..... 215/222
6,202,876 B1 * 3/2001 DeJonge ..... 220/217
6,213,323 B1 * 4/2001 Ferrari ..... 215/272
6,290,108 B1 * 9/2001 Gross ..... 222/494
6,293,431 B1 * 9/2001 Seymour et al. ..... 222/83
6,299,038 B1 * 10/2001 Schmeisser et al. ..... 222/521
6,315,165 B1 * 11/2001 Regan ..... 222/103
6,334,555 B1 * 1/2002 Randall et al. ..... 222/521
6,378,713 B2 * 4/2002 Montgomery ..... 215/222
6,450,352 B1 9/2002 DeJonge
7,004,340 B2 * 2/2006 Belden, Jr. ..... 215/215
7,017,782 B2 * 3/2006 Harrold ..... 222/153.1
7,100,783 B2 * 9/2006 Belden, Jr. ..... 215/215
7,100,784 B2 * 9/2006 Belden, Jr. ..... 215/215
7,168,435 B2 * 1/2007 Vieu et al. ..... 132/294
7,350,652 B2 * 4/2008 Belden, Jr. ..... 215/215
7,350,653 B2 * 4/2008 Belden, Jr. ..... 215/215
7,350,654 B2 * 4/2008 Belden, Jr. ..... 215/215
7,350,655 B2 * 4/2008 Belden, Jr. ..... 215/215
7,435,027 B2 * 10/2008 Hetzel ..... 401/47
7,621,411 B2 * 11/2009 Doherty et al. ..... 215/228
7,635,071 B1 * 12/2009 Montgomery et al. ..... 222/546
7,648,051 B1 * 1/2010 Montgomery et al. .. 222/153.09
7,665,637 B2 * 2/2010 Foster ..... 222/521
7,677,413 B2 * 3/2010 Rahim et al. ..... 222/83
8,002,149 B2 * 8/2011 Leonard ..... 222/153.1
2001/0019033 A1 * 9/2001 Montgomery ..... 215/332
2005/0072792 A1 * 4/2005 Harrold ..... 222/48
2005/0139621 A1 * 6/2005 Foster ..... 222/521
2006/0029459 A1 * 2/2006 Carroll ..... 401/206
2006/0278661 A1 * 12/2006 Cooper et al. ..... 222/321.1
2008/0035597 A1 * 2/2008 Leonard ..... 215/211
2009/0067913 A1 * 3/2009 Vintimiglia ..... 401/129

* cited by examiner

SAFETY CAP ASSEMBLY AND CONTAINER SYSTEM

CROSS-REFERENCE TO RELATED APPLICATIONS

The present utility application claims priority from U.S. provisional patent application No. 60/978127 entitled "Safety Cap and Container System" and filed on Oct. 7, 2007.

STATEMENT REGARDING FEDERALLY SPONSORED RESEARCH OR DEVELOPMENT

Not applicable.

BACKGROUND OF THE INVENTION

1. Field of Invention

The present application is in the field of safety caps and containers.

2. Background of the Invention

Many hazardous substances are useful around the home, office, work space, and/or garage. Ideally, these substances would be readily accessible for capable users, while at the same time inaccessible to others unable to handle the responsibilities associated with such substances (for example, small children).

SUMMARY OF THE INVENTION

Accordingly, it is an objective of the present application to provide a safety cap and container which resists opening by children. Specifically, it is the object of the invention to provide a safety cap which cannot be simply pulled apart or removed by a simple rotation.

It is a further object of the present application to provide a safety cap having an optional compression member which increases the axial force required to remove the cap from a cooperating container.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures in which:

FIG. 8 is meant to illustrate and inventory some of the individual components of the safety cap 600 and container 100 system, while also representing a plan for fitting various components together to construct the safety cap 600 and container 100 of FIG. 7.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Figure 1:
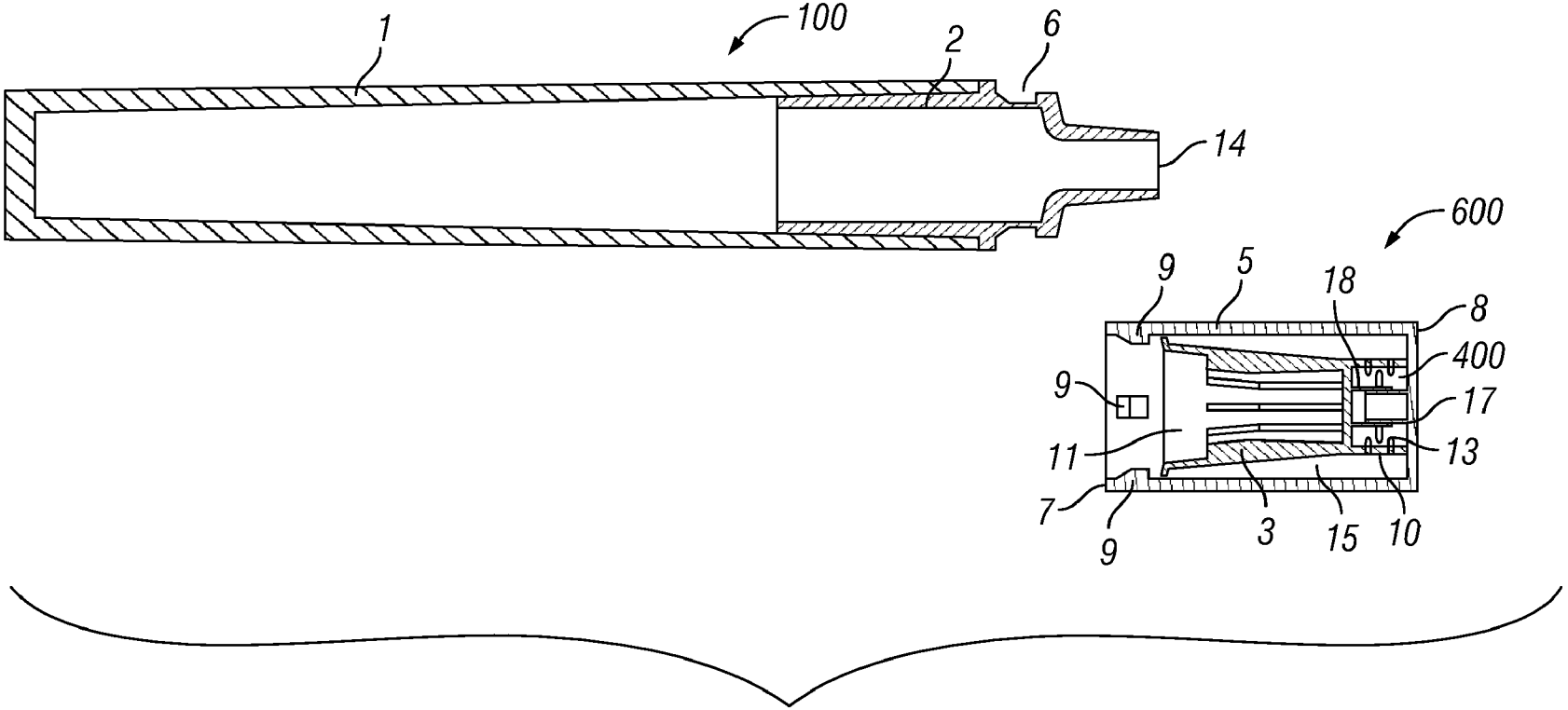
FIG. 1 is a cross-section of the cooperating container 100 and safety cap 600 disassociated to permit access to a contained substance.

FIG. 1 illustrates the cooperating container 100 and safety cap 600 dissociated to allow access to a contained substance. Typically, the container 100 features a body 1 with an adapter 2 assembled therein. The adapter 2 provides an exit 14 for a contained substance, and features a number of circumferentially spaced radially recessed projections which have notches 6 therein. In the present embodiment, the safety cap 600 is primarily defined by two structures: (1) an outer cap 5 suitably defined by a one piece hollow cylinder having an open base 7 with a closed top 8, a hollow 15, a number of circumferentially spaced lugs 9 extending radially inward at the cap hollow 15, and a rigid axial extension 17 at the inside of the top 8; and, (2) an inner cap 3 which is typically configured at one end 11 to accommodate the exit 14 when the adapter 2 is inserted therein, and defined at the other end by a flexor 10 and acceptor 18 which are separated by an inside cavity 400. The inner cap 3 is fixedly and slidably assembled concentrically within the outer cap 5 at the hollow 15 by interaction between the extension 17 and the acceptor 18. The flexor 10 features vents 13 which produce a spring force when the flexor 10 is compressed. The interaction between the extension 17 and acceptor 18 is typically such that the flexor 10 abuts the inside of top 8 and can be electively compressed thereagainst or fully extended therefrom. However, while in equilibrium, the flexor 10 will usually be fully extended due to the spring force provided by the vents 13 against compression.

Figure 2:
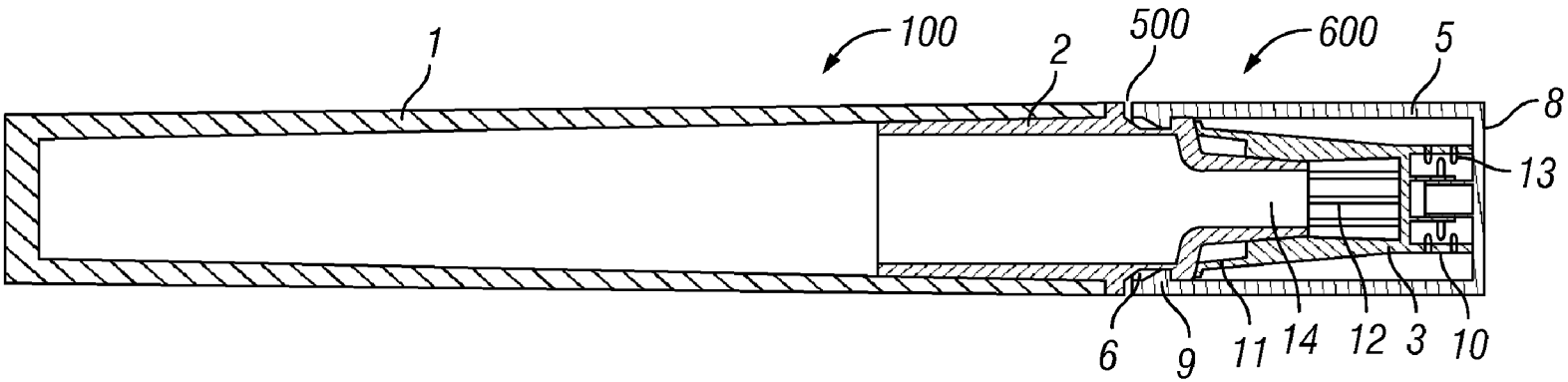
FIG. 2 is a cross-section of the cooperating container 100 and safety cap 600 intimately interlocked to prevent routine access to a contained substance.

Routine access to a contained substance usually occurs when a cap may be simply pulled or rotated for removal (or any other non-prophylactic cap removal method). FIG. 2 illustrates a container 100 and safety cap 600 intimately interlocked to prevent routine access to a contained substance. In this figure, the safety cap 600 is situated over the exposed end of the adapter 2 with the body 1 extending distally. As discussed further below, the lugs 9 on the inside of the outer cap 5 are cooperating with the corresponding notches 6 to prevent safety cap 600 removal by twisting (i.e., safety cap 600 radial movement) or pulling (i.e., safety cap 600 axial movement away from the body 1). The exit 14 on the adapter 2 is covered by the adapted end 11 of the inner cap 3 and the flexor 10 is partially compressed. The spring force delivered by vents 13 as a result of the partial flexor 10 compression, pushes the adaptor 2 at the adapted end 11 of the inner cap 3, and pulls lugs 9 on the outer cap 5 against the notches 6 in the adapter 2. Thus, the existence of space 500 and a constant resistance to axial cap 600 movement toward the body 1. The adapted end 11 of the inner cap 3 may suitably contain a number of ribs 12 to support compressive forces.

Figure 3:
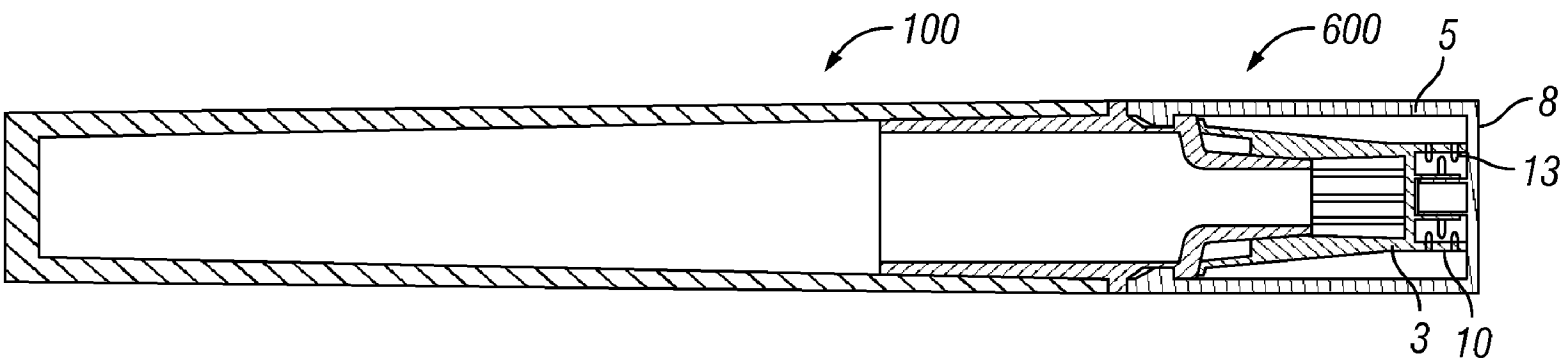
FIG. 3 is a cross-section of the cooperating container 100 and safety cap 600 compressed in transition between the FIG. 1 and FIG. 2 positions.

FIG. 3 illustrates the container 100 and safety cap 600 of FIGS. 1 and 2 wherein the flexor 10 is compressed while the safety cap 600 is displaced axially toward the body 1. Such flexor compression may be accomplished by asserting an axial external force at the body toward the safety cap 600 (which acts primarily on the inner cap 3), and by applying an opposing force at the cap top 8 (which acts primarily on the outer cap 5), whereby the resulting force is sufficient to overcome the spring force of the vents 13 to result in flexor 10 compression. As discussed in greater detail below, when a compression force sufficiently depletes space 500, safety cap 600 may be torqued relative to the adapter 2 to effectuate safety cap 600 removal. When such compressing force is dissipated without safety cap 600 removal, the spring force delivered by vents 13 returns the safety cap 600/container 100 system to the FIG. 2 position.

Figure 4:
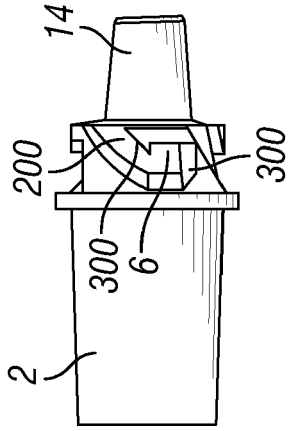
FIG. 4 is a side perspective view of the adapter 2 of the cooperating container 100.

FIG. 4 is a side view of adapter 2, and when viewed in conjunction with FIGS. 1, 2 and 3 illustrate safety cap 600 placement and removal. Beginning with FIGS. 1 and 4, cap placement is accomplished as follows: safety cap 600, in equilibrium, is positioned over adapter 2 such that lugs 9 align to engage the corresponding lug paths 200 and exit 14 is accepted by adapted end 11 of the inner cap 3; a torque and compressive force are simultaneously applied to the system whereby the adapter 2 presses on the inner cap 3 to compress flexor 10, and whereby lugs 9 traverse the tapered lug paths 200 until the safety cap 600 and container are in the FIG. 3 position; the compressive force is released, thereby allowing the spring force of the flexor 10 to drive the system to its FIG. 2 position. The notches 6 prevent safety cap 600 removal from simple pulling, and the stop 300 prevents cap 600 rotation. Beginning with FIGS. 2 and 4, safety cap 600 removal is accomplished as follows: a compressive force is applied to the system whereby the adapter 2 presses on the inner cap 3 to compress flexor 10 to the FIG. 3 position; a torque is added simultaneous with the release of the compressive force, whereby the spring force of the flexor 10 drives the safety cap 600 along the lug paths 200 until the flexor 10 achieves equilibrium; the exit 14 is removed from the inner cap and the safety cap 600 and container 100 are separated.

Figure 6:
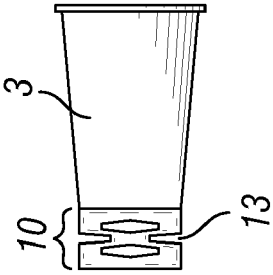
FIG. 6 is a side perspective view of the inner cap 3 depicted in FIG. 5, rotated by 90 degrees.
Figure 5:
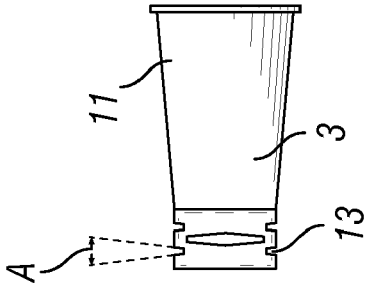
FIG. 5 is a side perspective view of the inner cap 3 of the safety cap 600.

FIGS. 5 and 6 are a side view of the inner cap of the present embodiment rotated by 90 degrees with respect to each other. These figures depict the dichotomy between the first end 11 adapted to receive the adapter exit 14 and the flexor 10 in the inner cap 3. These figures also depict a suitable embodiment of flexor 10 and the associated vents 13. When the flexor 10 is compressed, gap(s) A is substantially shut. The inner cap 3 is made from a suitable plastic material which provides the desired flexibility and resiliency. Such material will be readily apparent to those skilled in the applicable art.

Figure 7:
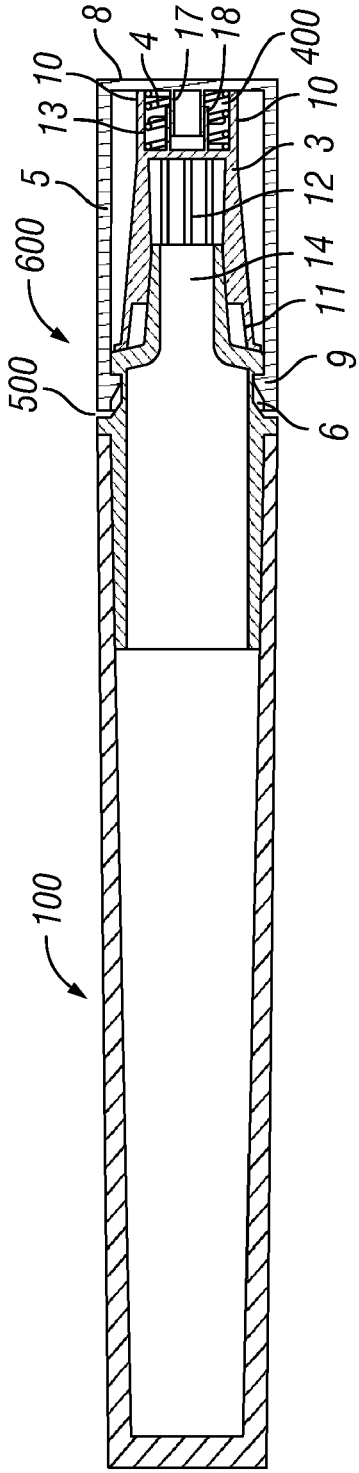
FIG. 7 is a cross-section of the cooperating container 100 and safety cap 600 of FIG. 1 with the additional feature of a compressible member 4.

FIG. 7, like FIG. 2, illustrates a container 100 and safety cap 600 intimately interlocked to prevent routine access to a contained substance. However, FIG.7 contains the additional feature of a compression member 4 positioned between the flexor 10 and acceptor 18 at the inside cavity 400. The compression member 4 is sandwiched between to inside of the external cap top 8 and the top of the internal cap 3. The compression member 4 supplements flexor 10 and adds additional resistance to flexor 10 depression. Accordingly, a safety cap 600 featuring a compression member increases the axial force necessary to remove the safety cap 600 when in a FIG. 7 position. Other than the increased resistance to flexor 10 depression, safety cap 600 placement and removal are accomplished in substantially the same manner discussed above.

Figure 8:
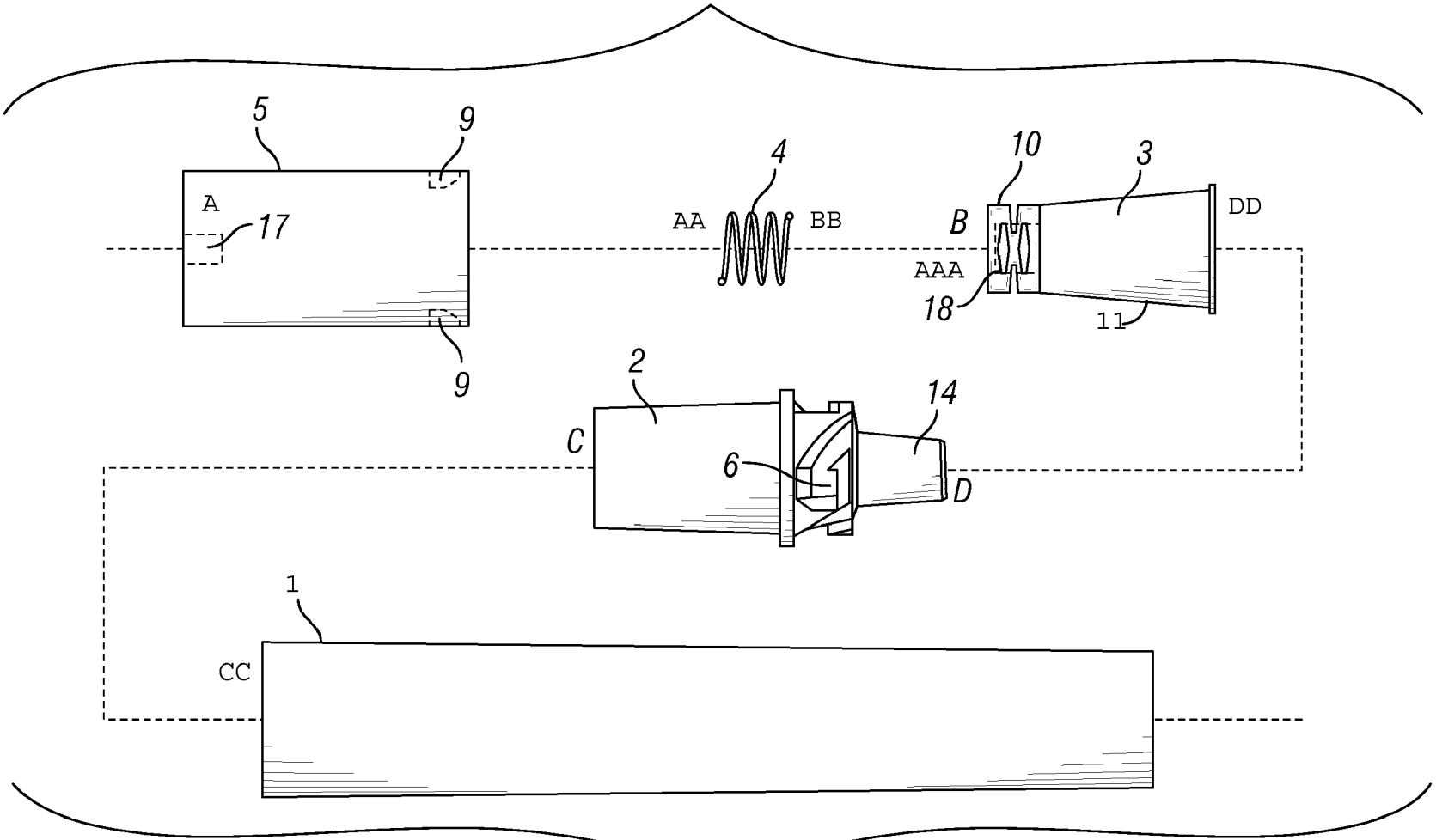
FIG. 8 is the exploded cooperating container 100 and safety cap 600 of FIG. 7.

FIG. 8 is an exploded view of a typical safety cap 600 and container 100 embodiment contemplated by the present application. This figure is meant to provide an inventory of necessary components, and provide a crude assembly guide. The figure includes a compressible member 4, but embodiments not featuring such compressible member are assembled in substantially the same manner. Following the dashed line generally from the bottom left to the top right of the figure, assembly is accomplished as follows: the rigid axial extension 17 is masculinely inserted into the compression member 4 (A to AA); the acceptor 18 in the internal cap 3 masculinely inserts into the compression member 4 (B to BB), but femininely receives the rigid axial extension 17 (A to AAA)until the flexor 10 abuts the inside of the external cap top 8; the body, femininely receives the male end of adapter 2 (C to CC); and, Finally, the safety cap 600 is positioned or removed as discussed above (D to DD).

In general then, the invention of the present application is a cap comprising a compressible member, and a means for electively coupling said cap over the opening of an affiliated container, said means activated via compression of said compressible member.

I claim:

1. A container system comprising:

a container comprising:

a body operationally configured to house a substance;

a dispensing adapter for dispensing said substance from said body, said dispensing adapter having:

a lug path having a notch, and an outlet;

a safety closure comprising:

a removable outer cap having:

a skirt, and, a lug disposed on an interior surface of said skirt, said lug configured to cooperate with said notched lug path;

an inner cap having:

a compressible end having six tessellatedly and mirroredly positioned vents, and said compressible end is a flexor, and a lower end configured to engage said outlet;

a spring configured to resist compressing said compressible end;

wherein coupling the closure to the container requires engaging said removable outer cap with said dispensing adapter to close said outlet and compressing said compressible end to move the lug along the lug path into the notch; and, wherein uncoupling the closure from the container requires compressing said flexor to release the lug from the notch of the notched lug path.

2. The container system of claim 1, wherein said safety closure is removable.

3. The container system of claim 1, wherein the spring is positioned within the compressible end of the inner cap.

4. The container system of claim 1, wherein said notched lug path is tapered.

5. The container system of claim 1, wherein said association of the lug and the notch of the notched lug path is configured to prevent a disengagement of said inner cap from said dispensing adapter by pulling or twisting.

6. The container system of claim 1, wherein said vents are positioned around the periphery of the compressible end.

* * * * *